US007018077B2

(12) United States Patent
Mullen

(10) Patent No.: US 7,018,077 B2
(45) Date of Patent: Mar. 28, 2006

(54) ATTACHMENT FOR A LIGHT FIXTURE FOR RETAINING LENSES

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 0 days.

(21) Appl. No.: 11/060,293

(22) Filed: Feb. 17, 2005

(65) Prior Publication Data

US 2005/0168989 A1 Aug. 4, 2005

Related U.S. Application Data

(63) Continuation of application No. 10/121,324, filed on Apr. 11, 2002, now abandoned.

(51) Int. Cl.
*F21V 17/06* (2006.01)

(52) U.S. Cl. ..... 362/455; 362/311

(58) Field of Classification Search ..... 362/455, 362/408, 311

See application file for complete search history.

(56) References Cited

U.S. PATENT DOCUMENTS 5,400,231 A * 3/1995 Huang ..... 362/253
6,590,721 B1 * 7/2003 Onda ..... 359/819

* cited by examiner

*Primary Examiner*—Stephen Husar
*Assistant Examiner*—Hargobind S. Sawhney
(74) *Attorney, Agent, or Firm*—Kelly Lowry & Kelley, LLP

(57) ABSTRACT

The present invention is directed toward an attachment for a light fixture. More specifically, the present invention is directed toward an attachment for retaining one or more lenses in position for use with light fixtures that have a housing in which the light source is recessed. The lenses may be, for example, colorless transparent lenses, colored transparent lenses, colorless translucent lenses, colored translucent lenses, louvered grates, and diffusing grids. Further, the lenses may be made out of any material that is known in the art or has yet to be developed, but are preferably made of a rigid material such as plastic. The preferred embodiment of the present invention comprises generally an attachment body and an attachment insert. The attachment body comprises an inner sleeve, a means for retaining the inner sleeve on a recessed housing, an upper eave connected to the inner sleeve, a recessed cavity in the upper eave, and a means for securing the attachment insert to the attachment body. The attachment insert is designed to rest in the recessed cavity of the upper eave. The attachment body is adapted to have dimensions such that the inner sleeve fits inside the housing of a recessed light fixture. In addition, the inner sleeve and upper eave define voids and it is generally desirable for the inner sleeve, upper eave and voids to have dimensions such that light is permitted to pass there through. The attachment insert is removably connected to the attachment body and supports a lens. In the preferred embodiment, the attachment insert is constructed such that it retains one or more lenses substantially in the recessed cavity contained in the upper eave. The means for connecting the attachment insert to the attachment body in the preferred embodiment is a screw thread on an outer surface of the attachment insert that is compatible with a screw thread on an inner surface of the attachment body.

25 Claims, 5 Drawing Sheets

ATTACHMENT FOR A LIGHT FIXTURE FOR RETAINING LENSES

CROSS-REFERENCE TO RELATED APPLICATION

This is a continuation of U.S. Ser. No. 10/121,324, filed Apr. 11, 2002 now abandoned.

STATEMENT RE: FEDERALLY SPONSORED RESEARCH AND DEVELOPMENT

Not Applicable.

FIELD OF THE INVENTION

The present invention relates to attachments for light fixtures. More specifically, the present invention relates to an attachment for retaining one or more lenses in position for use with a light fixture having a recessed lamp housing.

BACKGROUND OF THE INVENTION

Generally, U.S. Pat. No. 2,878,374 ('374) discloses a lens holder for use in conjunction with indoor and outdoor reflector lamps. More specifically, the '374 patent discloses a lens holding device for use with reflector lamps comprising, among other things, a collar with an annular flange that fits around and secures to a reflector lamp, a lens, and a spring for holding the lens against the annular flange and away from the reflector lamp. In addition, the '374 patent discloses that the lenses in the device are interchangeable such that a colored lens may be substituted for a colorless lens and therefore a single clear lamp may be converted to a colored light by interchanging one lens for another.

Other prior art patents, including but not necessarily limited to U.S. Pat. Nos. 5,144,540 ('540) and 2,510,873 ('873), disclose light fixtures that use lenses. However, these prior art patents generally disclose a light fixture that uses lenses and do not disclose an attachment to a light fixture for retaining lenses for use with an existing light fixture. In addition, the prior art patents generally do not disclose or suggest the changing of lenses by a user or the general interchanging of lenses within the device. Furthermore, a drawback of many of the prior art devices is that they do not allow for easy replacement of the lenses because a user would, in many instances need to disassemble the fixture or lens retaining portion in order to change a lens.

ADVANTAGES OF THE INVENTION

One advantage of the present invention is that it provides an attachment for a light fixture which is useable with various structures of light fixtures.

Another advantage of the present invention is that it provides an attachment for a light fixture which is useable with a recessed light fixture.

Another advantage of the present invention is that it provides an attachment for a light fixture which allows for the use of various lenses with a light fixture, including but not limited to colored lenses or light louvers.

Another advantage of the present invention is that it provides an attachment for a light fixture which has a low profile when used in conjunction with a light fixture.

Another advantage of the present invention is that it provides an attachment for a light fixture which will function in most existing prior art fixtures without modification.

BRIEF SUMMARY OF THE INVENTION

The present invention is directed toward an attachment for a light fixture. More specifically, the present invention is directed toward an attachment for retaining one or more lenses in position for use with light fixtures that have a housing in which the light source is recessed. The lenses may be, for example, colorless transparent lenses, colored transparent lenses, louvered grates, and diffusing grids. Further, the lenses may be made out of any material that is known in the art or has yet to be developed, but are preferably made of a rigid material such as plastic. The preferred embodiment of the present invention comprises generally an attachment body and an attachment insert. The attachment body, comprises an inner sleeve connected to an upper eave. The inner sleeve includes a means for retaining the attachment body within the housing of a recessed light fixture. The upper eave includes a means for securing the attachment insert to the upper eave.

In the preferred embodiment of the present invention, the inner sleeve and upper eave define concentric voids such that the voids are oriented in the same direction in space and light may pass substantially through the voids when the attachment body is applied to the housing of a recessed light fixture. In addition, the inner sleeve is designed to have dimensions such that the outer surface of the inner sleeve fits inside the housing of a recessed light fixture. Generally, it is desirable for the attachment body to have dimensions such that light may pass substantially through the voids defined by the inner sleeve and upper eave of the attachment body. In the preferred embodiment, the means for connecting the attachment body to the housing of the recessed light fixture requires the inner sleeve to be of such diameter that it may be push-fit upon the housing and a securing means in the inner sleeve designed to secure the inner sleeve to the housing.

The void defined by the upper eave is designed as a recessed cavity adapted to receive the attachment insert. The recessed cavity includes a securing means designed to retain the attachment insert in the recessed cavity as described below. Preferably, the upper eave has a diameter slightly larger than the inner sleeve such that the upper eave extends beyond the edge of the housing of a recessed light fixture to provide greater leverage and control for the user.

In the preferred embodiment, the attachment insert comprises a lens generally shaped to fit snugly within the recessed cavity within the upper eave. The attachment insert comprises a lens portion and a complimentary securing means. The lens portion is designed to fill in or cover the void defined by the upper eave and inner sleeve. The complimentary securing means is designed to act in conjunction with the securing means in the recessed cavity to secure the attachment insert within the upper eave.

In operation, the attachment body fits generally inside the housing of a recessed light fixture such that the outer surface of the inner sleeve is substantially within and in contact with the inner surface of the housing. The upper eave may be positioned within the recessed housing such that the upper eave rests substantially upon the rim of the housing. The attachment insert may be placed within the recessed cavity of the upper eave and secured in position such that the lens of the attachment insert is generally retained substantially over the void defined by the inner sleeve and upper eave.

DETAILED DESCRIPTION OF THE INVENTION

Figure 1:
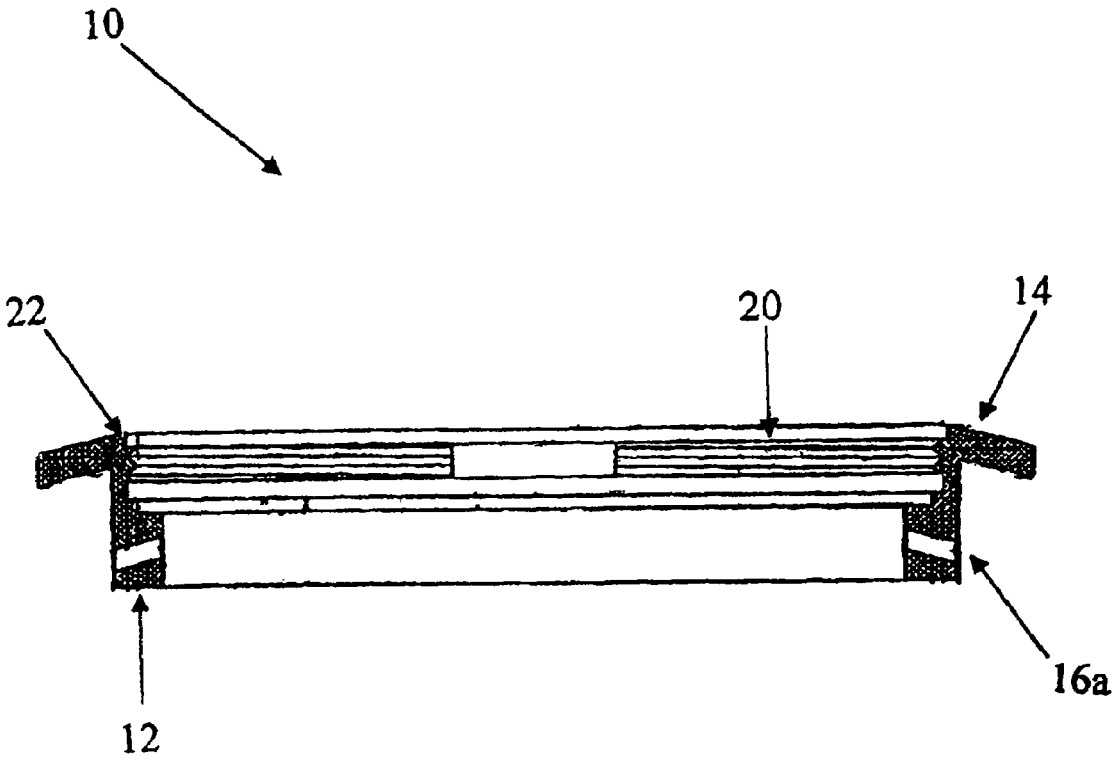
FIG. 1 shows a side cross-sectional view of the attachment body of the preferred embodiment of the present invention.
Figure 2:
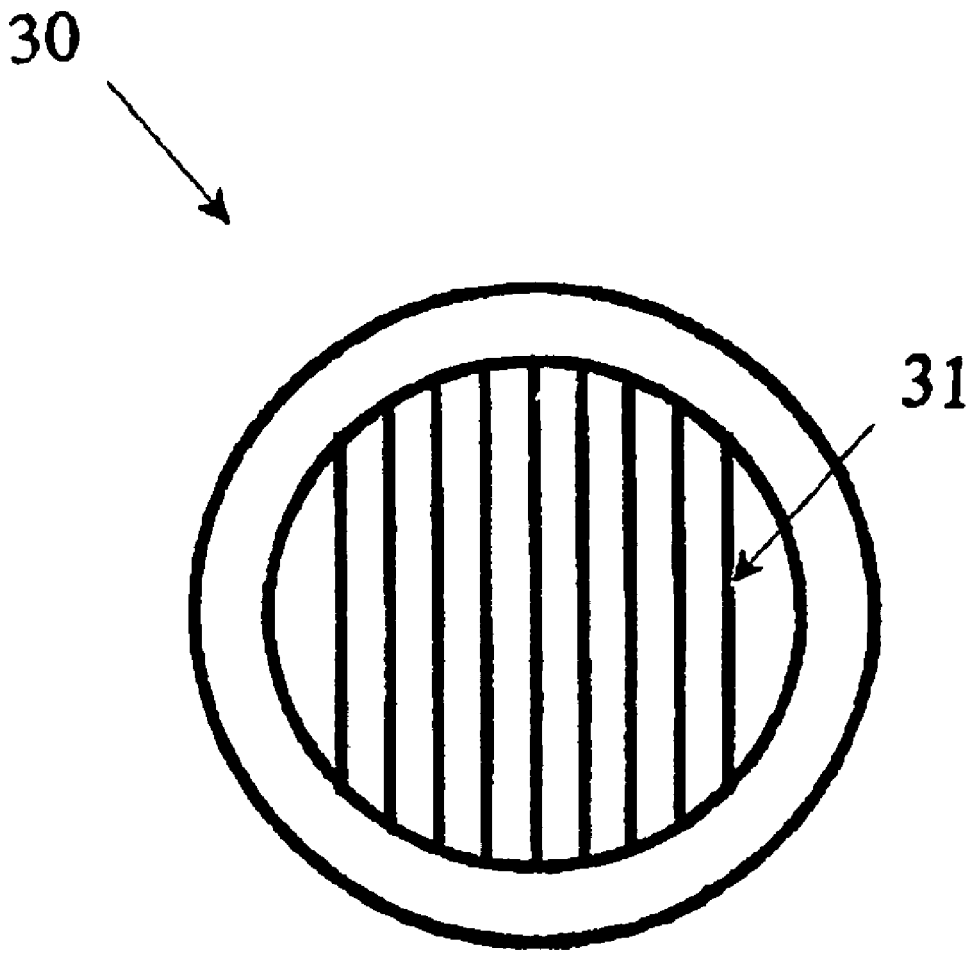
FIG. 2 shows a top view of the attachment insert of the preferred embodiment of the present invention.
Figure 3:
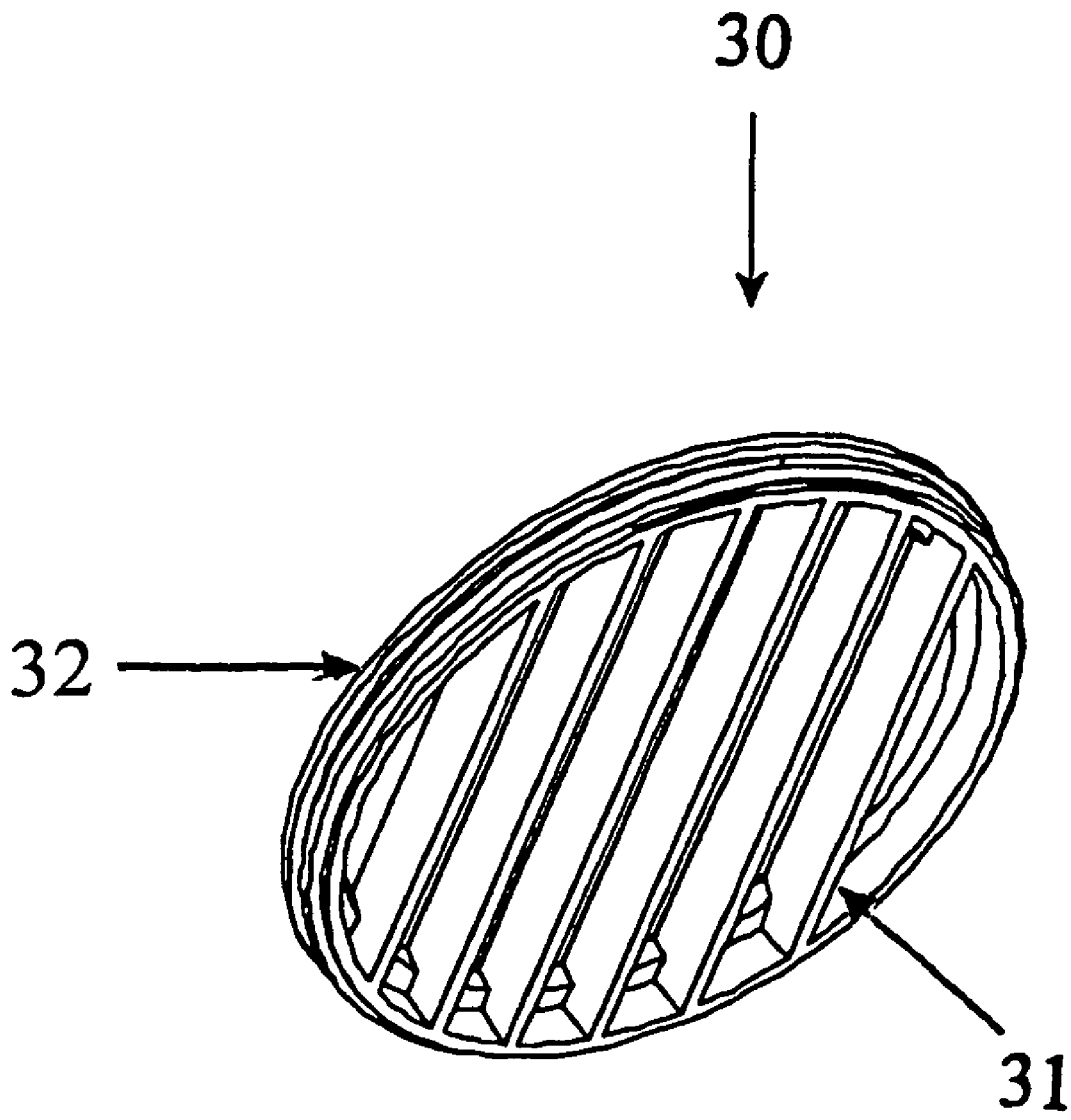
FIG. 3 shows a bottom perspective view of the attachment insert of the preferred embodiment of the present invention.
Figure 4:
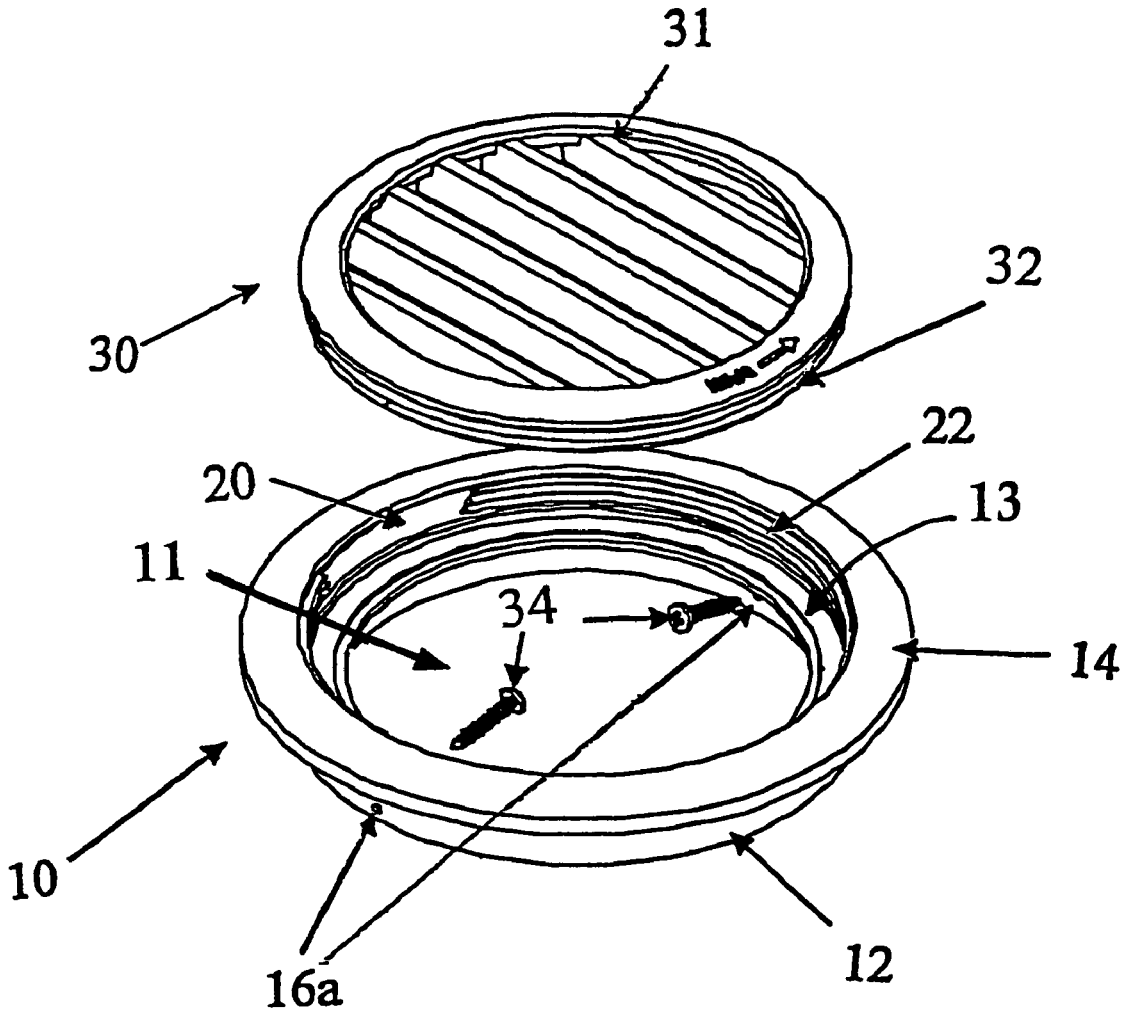
FIG. 4 shows a top perspective exploded view of the attachment body in the attachment insert of the preferred embodiment of the present invention.
Figure 5:
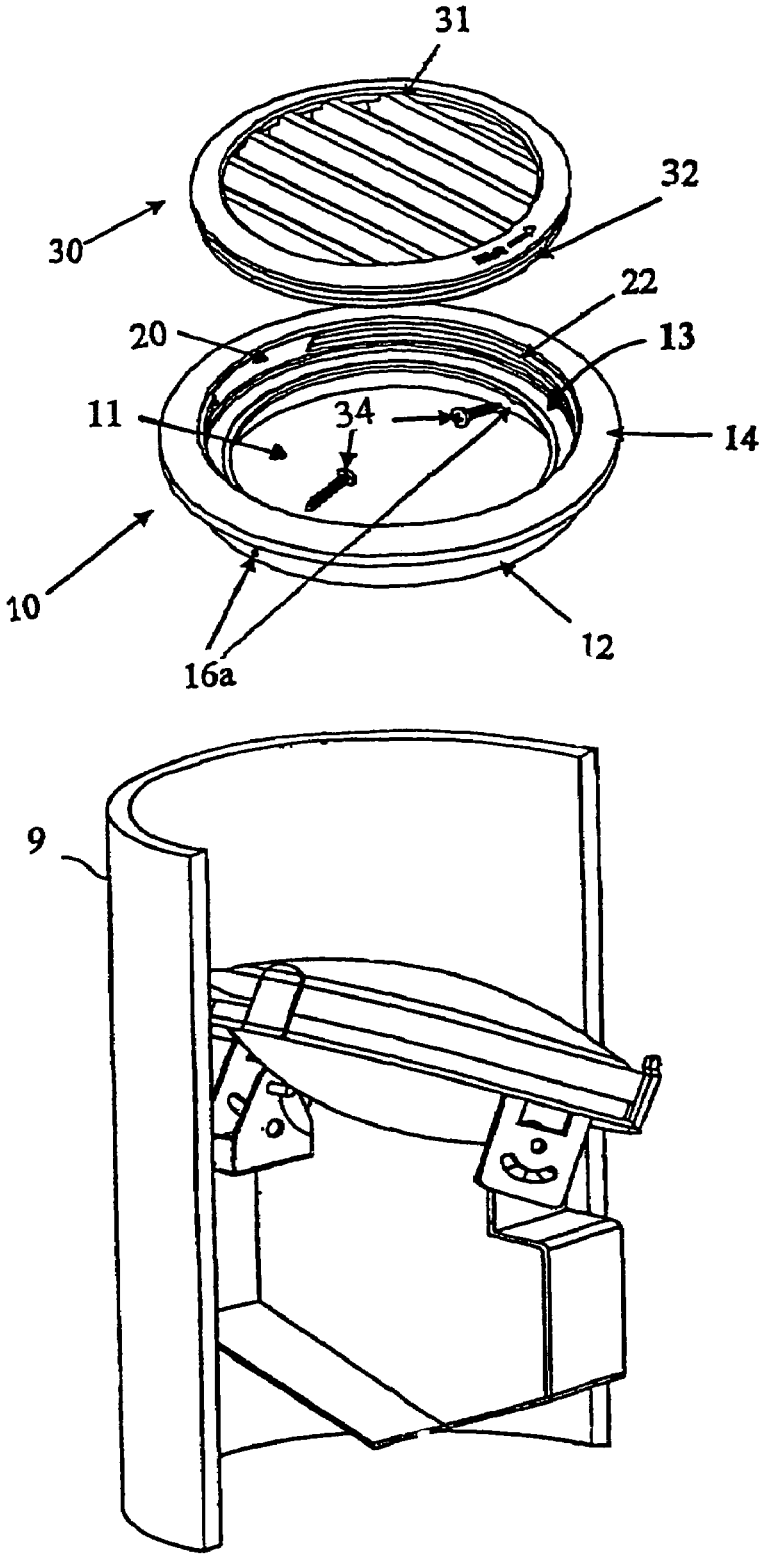
FIG. 5 shows a perspective view of the attachment body in the attachment insert of the preferred embodiment of the present invention in conjunction with a cut away cylindrical light fixture housing.

The present invention is directed toward a lens ring for use with lighting fixtures. Specifically, this invention is aimed at providing a lens ring for use with lighting fixtures having a housing (9) in which the light source is recessed. The lens ring of the present invention consists of an attachment body (10) and an attachment insert (30). FIG. 1 depicts the attachment body (10) of the present invention. The attachment body (10) comprises an inner sleeve (12) and an upper eave (14) connected to the inner sleeve (12). The inner sleeve (12) includes a retaining means described more fully below. The inner sleeve (12) and upper eave (14) define concentric voids (11,13). The void (13) of the upper eave (14) comprises a recessed cavity (20) and a lens securing means (22) therein.

The attachment body (1) of the lens ring is designed to attach to an end of a housing (9) of a light fixture. The attachment body (10) is designed to be shaped generally the same as the shape of the housing (9) of a light fixture. The attachment body (10) may be configured in any shape that a light fixture housing (9) may be configured. For example, in the case of a cylindrical light fixture housing (9), the attachment body (10) is cylindrical; in the case of a rectangular light fixture housing (9), the attachment of body (100 is rectangular (not shown), and in the case of a triangular light fixture housing (9), the attachment body (10) is triangular. The preferred embodiment of the present invention has a cylindrical attachment body (10), therefore, the remainder of this description will discuss a cylindrical attachment body (10). However, a person of ordinary skill in the art will recognize that the attachment body (10) may be of any shape and still function as intended so long as the attachment body (10) is the same shape as the housing (9) of the light fixture.

In the preferred embodiment, the inner sleeve (2) is cylindrical in shape and has an inner diameter and an outer diameter. The inner sleeve (12) should be roughly the same size and shape as the housing (9) of the light fixture. In the preferred embodiment, the outer diameter of the inner sleeve (12) is slightly smaller than the inner diameter of the housing (9) such that the inner sleeve (12) fits inside the housing (9). Alternatively, one of ordinary skill in the art would recognize that the inner sleeve (12) may have an inner diameter slightly larger than the outer diameter of the housing (9), thus fitting outside the housing (9).

The inner sleeve (12) includes a retaining means. The retaining means retains the inner sleeve (12) in position within the housing (9). The retaining means can be any means known in the art, including but not limited to set screws, a retaining gasket, male-female dimples, lugs and recessed channels, threads, retaining clips, or a ridge and channel. If the retaining means is a means that requires two or more complementary structures to be functional, the compliment(s) to the structure(s) included on the inner sleeve (12) may be included or attached to the housing (9). In the preferred embodiment, the retaining means consists of two set screws (34) that are inserted into two pre-drilled holes (16*a*). When the set screws (34) are utilized, the tips of the set screws (34) advance through the pre-drilled holes (16*a*) and contact the inner wall of the housing (9). The force exerted by the set screws (34) retains the attachment body (10) through friction and restricts movement of the attachment body (10) in relation to the housing (9).

The upper eave (14) is connected to the inner sleeve (120 and generally contacts the end of the housing (9). The upper eave (14) has an outer diameter slightly larger than the outer diameter of the housing (9) and over reaches the edge of the housing (9). The upper eave (14) also has an inner diameter slightly larger than the inner diameter of the inner sleeve (12). The recessed cavity (20) is defined in part by the upper eave (14), along with the inner sleeve (12). In addition, the recessed cavity (20) has a diameter equal to the inner diameter of the upper eave (14). Each of the inner sleeve (12), the upper eave (14), and the recessed cavity (20) are generally oriented around the same center point. In the preferred embodiment, this configuration of elements makes each of the inner sleeve (12), the upper eave (14), and the recessed cavity (20) concentric with the other elements.

The recessed cavity (20) includes a securing means (22) designed to secure the attachment insert (30). The attachment insert (30) is generally in the shape of a flat disc that is approximately the same size and shape as the diameter of the recessed cavity (20). In the preferred embodiment, the recessed cavity (20) and lens insert (30) are circular as the attachment body (10) discussed above. The attachment insert (30) includes a complementary securing means (32) on its perimeter designed to cooperate with the securing means (22) contained in the recessed cavity (20).

The securing means (22) and the complimentary securing means (32) may be any securing means known in the art such as threads, retaining gaskets, lugs and recessed channels, male-female dimples, retaining clips, ridges and channels, etc. In the preferred embodiment, the securing means are threads. According to the preferred embodiment, the attachment insert (30) may be easily removed and replaced through operation of the securing means (22) and the complimentary securing means (32).

The attachment insert (30) may include a lens portion (31). Further, the lens portion (31) may be one of several structures. In the preferred embodiment, the lens portion (31) may comprise a structure selected from the group consisting of a transparent lens, a translucent lens, a colored lens, a louvered grate (depicted), a diffusing grid, and any type of lens device now known or to be developed. In alternative embodiments, the lens portion (31) may define a void permitting the unobstructed passage of light through the attachment insert (30). The ease with which the attachment insert (30) may be removed and replaced, permits a user to change types of lenses easily. The removal of the attachment insert (30) also permits a user to easily access the interior of the light fixture housing (9) without removing the entire attachment body (10).

In the operation of the preferred embodiment, the attachment body (10) generally fits onto and covers the end of a light fixture housing (9). The inner sleeve (12)is inserted into the light fixture housing (9). The attachment body is positioned such that the upper eave (14) rests flush against the edge of the light fixture housing (9). The retaining means (16*a*,34) hold the inner sleeve (12) and upper eave (14) in place against the light fixture housing (9). The attachment insert (30) is inserted into the recessed cavity (20) with the securing means (22) and the complimentary securing means (32) operating to retain the attachment insert (30) in the recessed cavity (20). In this way, the lens ring of the present invention covers the end of the light fixture housing (9), provides protection for and supports a lens for use with recessed light fixtures. The function and structure of the lens ring allows a person to use alternate lens structures in a light fixture while providing easy, ready access to the light fixture.

Each component of the present invention, except the lens portion and some alternate retaining and securing means (22 and 32), may be constructed from any rigid moldable material. The rigid, moldable material may be any material selected from the group consisting of plastic, ceramic, rubber and metal. The skilled artisan will recognize that such materials are commonly used in lighting fixtures and lighting accessories and will also recognize that various types of each of these materials have varying amounts of rigidity. In addition, each part of the present invention may be constructed from different materials. In the preferred embodiment, each of the elements are constructed from black, rigid plastic. The lens portion (31) may be constructed from glass or plastic.

The above-described preferred embodiments are intended to illustrate the principles of the invention, but not to limit its scope. Other embodiments and variations of these preferred embodiments will be apparent to those skilled in the art and may be made without departing from the spirit and scope of the invention as defined in the following claims.

I claim:

1. A lens ring for retaining one or more lenses for use with a recessed light fixture having a light fixture housing comprising:

an attachment body, comprising an inner sleeve and an upper eave connected to the inner sleeve; said inner sleeve defining a void and having a retaining means; said inner sleeve configured to connect to the light fixture housing; said retaining means in the inner sleeve configured to retain the inner sleeve in fixed relation to the light fixture housing; said upper eave defining a void and having a recessed cavity and an integral securing means comprising internal threads; an attachment insert comprising a lens portion and an integral complimentary securing means comprising external threads; said attachment insert securely received inside said recessed cavity; wherein said internal threads of the securing means and said external threads of the complimentary securing means operate together to secure the attachment insert within the recessed cavity; and said attachment insert oriented within the recessed cavity and removably connected to the upper eave by said securing means and said complimentary securing means.

2. The lens ring of claim 1 wherein, said void defined by the inner sleeve and said void defined by the upper eave are oriented in the same direction in space.

3. The lens ring of claim 1 wherein, said attachment body is made from a material selected from the group consisting of plastic, metal, and ceramic.

4. The lens ring of claim 1 wherein, said attachment insert without the lens portion is made from a material selected from the group consisting of plastic, metal, and ceramic.

5. The lens ring of claim 1 wherein, said attachment body and said attachment insert without the lens portion are made from a material selected from the group consisting of plastic, metal, and ceramic.

6. The lens ring of claim 1 wherein, said void defined by the inner sleeve is configured such that light substantially passes through said void.

7. The lens ring of claim 1 wherein, said void defined by the upper eave is configured such that light substantially passes through said void.

8. The lens ring of claim 1 wherein, said void defined by the inner sleeve and said void defined by the upper eave are both configured such that light substantially passes through said voids.

9. The lens ring of claim 1 wherein, said lens portion of the attachment insert comprises a material selected from the group consisting of colorless transparent lenses, colored transparent lenses, colorless translucent lenses, and colored translucent lenses.

10. The lens ring of claim 1 wherein, said lens portion of the attachment insert comprises a configuration selected from the group consisting of louvered grates and diffusing grids.

11. The lens ring of claim 1 wherein, said attachment body and said attachment insert are substantially circular.

12. A lens ring for retaining one or more lenses for use with a recessed light fixture having a light fixture housing comprising:

an attachment body, comprising an inner sleeve and an upper eave connected to the inner sleeve; said inner sleeve defining a void and having a retaining means; said void defined by the inner sleeve configured such that light substantially passes through said void; said inner sleeve configured to connect to the light fixture housing; said retaining means in the inner sleeve configured to retain the inner sleeve in fixed relation to the light fixture housing; said upper eave defining a void and having a recessed cavity and an integral securing means comprising internal threads; said void defined by the upper eave configured such that light substantially passes through said void; an attachment insert comprising a lens portion and an integral complimentary securing means comprising external threads; said attachment insert securely received inside said recessed cavity; wherein said internal threads of the securing means and said external threads of the complimentary securing means operate together to secure the attachment insert within the recessed cavity; and said attachment insert oriented within the recessed cavity and removably connected to the upper eave by said securing means and said complimentary securing means.

13. The lens ring of claim 12 wherein, said void defined by the inner sleeve and said void defined by upper eave are oriented in the same direction in space.

14. The lens ring of claim 12 wherein, said attachment body is made from a material selected from the group consisting of plastic, metal, and ceramic.

15. The lens ring of claim 12 wherein, said attachment insert without the lens portion is made from a material selected from the group consisting of plastic, metal, and ceramic.

16. The lens ring of claim 12 wherein, said attachment body and said attachment insert without the lens portion are made from a material selected from the group consisting of plastic, metal and ceramic.

17. The lens ring of claim 12 wherein, said lens portion of the attachment insert comprises a material selected from the group consisting of colorless transparent lenses, colored transparent lenses, colorless translucent lenses, and colored translucent lenses.

18. The lens ring of claim 12 wherein, said lens portion of the attachment insert comprises a configuration selected from the group consisting of louvered grates and diffusing grids.

19. The lens ring of claim 12 wherein, said attachment body and said attachment insert are substantially circular.

20. A lens ring for retaining one or more lenses for use with a recessed light fixture having a fixture housing comprising:

an attachment body, comprising an inner sleeve and an upper eave connected to the inner sleeve wherein said attachment body is substantially circular; said inner sleeve defining a void and having a retaining means; said void defined by the inner sleeve is configured such that light substantially passes through said void; said inner sleeve configured to connect to the light fixture housing; said retaining means in the inner sleeve configured to retain the inner sleeve in fixed relation to the light fixture housing; said upper eave defining a void and having a recessed cavity and an integral securing means comprising internal threads; said void defined by the upper eave configured such that light substantially passes through said void wherein said void defined by the inner sleeve and said void defined by the upper eave are oriented in the same direction in space; an attachment insert comprising a lens portion and an integral complimentary securing means comprising external threads wherein said attachment insert is substantially circular; said attachment insert securely received inside said recessed cavity; and said attachment insert oriented within the recessed cavity and removably connected to the upper eave by said integral securing means and said integral complimentary securing means wherein said internal threads of the securing means and said external threads of the complimentary securing means operate together to secure the attachment insert within the recessed cavity.

21. The lens ring of claim 20, wherein, said attachment body is made from a material selected from the group consisting of plastic, metal, and ceramic.

22. The lens ring of claim 20, wherein, said attachment insert without the lens portion is made from a material selected from the group consisting of plastic, metal, and ceramic.

23. The lens ring of claim 20, wherein, said attachment body and said attachment insert without the lens portion are made from a material selected from the group consisting of plastic, metal, and ceramic.

24. The lens ring of claim 20, wherein, said lens portion of the attachment insert comprises a material selected from the group consisting of colorless transparent lenses, colored transparent lenses, colorless translucent lenses, and colored translucent lenses.

25. The lens ring of claim 20 wherein, said lens portion of the attachment insert comprises a configuration selected from the group consisting of louvered grates and diffusing grids.

* * * * *